United States Patent [19]

Winders et al.

[11] Patent Number: 4,476,924

[45] Date of Patent: Oct. 16, 1984

[54] GREASE INJECTION CONTROL HEAD HAVING A SPECIFIC GAS TRAP

[75] Inventors: Carl E. Winders, Lafayette, La.; Fred E. Watkins, Houston, Tex.

[73] Assignee: Camco, Incorporated, Houston, Tex.

[21] Appl. No.: 472,827

[22] Filed: Mar. 7, 1983

[51] Int. Cl.[3] ..... E21B 33/08

[52] U.S. Cl. ..... 166/84; 277/19

[58] Field of Search ..... 166/82–84, 166/70, 105.5, 105.6; 277/19, 59

[56] References Cited

U.S. PATENT DOCUMENTS

| | | | |
|---|---|---|---|
| 2,670,225 | 2/1954 | McKinney | 277/19 |
| 3,212,581 | 10/1965 | Marshall | 166/84 |
| 3,762,725 | 10/1973 | Taylor | 166/84 X |
| 4,090,573 | 5/1978 | Rankin | 166/84 X |

*Primary Examiner*—James A. Leppink
*Assistant Examiner*—Thuy M. Bui
*Attorney, Agent, or Firm*—Fulbright & Jaworski

[57] ABSTRACT

A grease injection control head for maintaining a seal about a wire performing wireline operations in a well. A tubular body includes a grease injection port for injecting grease for counteracting pressure in the well with a vent port above the injection port for venting fluids. A plurality of tubular members are provided in the body positioned between the injection port and the vent port. Each member includes a close fitting longitudinal bore for passage of a wireline for providing a grease pressure seal. The members are telescopically and sealably joined to adjacent members. The members include an enlarged cavity about the bore at each end for providing a turbulent grease chamber between adjacent members for distributing the pressure drop along the body for reducing loading on the wire and friction with a minimum length body. The length of a longitudinal bore relative to the longitudinal length of a chamber is no greater than 5:1. The body includes a second vent port above the first vent port for acting as a wiper vent port with one or more tubular members between the vent ports. A gas trap may be provided in the body below the injection port for trapping gas from the well. The trap includes means for diverting rising gas from the bore.

9 Claims, 4 Drawing Figures

GREASE INJECTION CONTROL HEAD HAVING A SPECIFIC GAS TRAP

BACKGROUND OF THE INVENTION

Wireline operations are used in the tubing of oil and/or gas wells to perform various operations such as running and removing various well tools. However, high pressure in the well requires that a proper seal must be maintained around the wireline because the escape of well fluids and gases may present a major hazard. However, sealing against the wire, particularly when high well pressure is encountered, increases the friction against the wireline and consequently increases the amount of weight required to pull the wireline downhole against well pressure as well as the force to pull the wireline upwardly through the seal. These requirements have shortened the depths at which the wireline operation may be performed. While grease injector heads have been used in the past in stranded line operations, they have not been used on smooth wire. In addition, gas rises and expands and reduces the sealing effect of grease.

The present invention is directed to a grease injection control head, which is particularly useful for use with a smooth wireline, for conducting wireline operations in a well which provides an effective seal, with reduced friction on the wireline, and which reduces the adverse effect on the seal of gas in the well.

Summary

One feature of the present invention is the provision of a grease injection control head for a wire and particularly smooth wire for performing wireline operations in a well in which the grease injector creates a pressure seal for sealing off the well pressure and also reduces the sealing friction on the wire thereby allowing the operations to be conducted at greater depths and higher pressures. The grease injector includes an elongate tubular body with an injection port in the body for injecting grease into the interior of the body for counteracting the pressure in the well. The body includes a vent port above the injection port for venting fluids from the interior of the body at substantially atmospheric pressure. A plurality of tubular members in the body are positioned between the injection port and the vent port and each of the members includes a close fitting longitudinal bore for passage of a wireline for creating a pressure drop and a pressure seal. The members are telescopically and sealably joined to adjacent members and the members have at each end an enlarged cavity about the bore for providing a turbulent grease chamber between adjacent members. The chamber distributes the pressure drop more evenly between the injection port and the vent port and reduces the loading on the wire and reduces the friction while maintaining a seal.

A still further object of the present invention is wherein the length of a longitudinal bore relative to the longitudinal length of a chamber is approximately 3:1 for maintaining the necessary seal to prevent escape of well fluids and gases, but at the same time reduces the friction on the wire between the injection port and the vent port. Preferably, the length of the longitudinal bore relative to the longitudinal length of a chamber is no greater than 5:1.

Yet a still further object of the present invention is wherein the body includes a second vent port above the first vent port for acting as a wiper vent port with a one or more tubular members in the body positioned between the vent ports.

A still further object of the present invention is wherein the diameter of the bore is approximately 0.004 inches larger than the diameter of the wire for maintaining a proper seal on the wire, but with a reduced friction drag.

Another object of the present invention is wherein a gas trap is provided in the body below the injection port for trapping gas from the well. The trap includes a housing with a longitudinally extending bore for accommodating a wireline and is positioned in the body. The housing may include an internal chamber surrounding but spaced from the bore for accumulating rising gas from the bore into the chamber. An opening extends from the bore to the chamber and the opening may include a circular opening surrounding the bore with the top of the opening closed by a partition extending from the chamber downwardly and inwardly to the bore to form a gas deflector for directing the gas from the line into the chamber. In addition, the bore may include an enlarged portion communicating with the chamber for injecting grease into the chamber.

A still further object is wherein the trap includes a housing positioned in the body with a longitudinally extending bore for accommodating a wireline. The exterior of the housing may be spaced from the interior of the body forming a space therebetween. At least one passageway extends upwardly from the bore through the housing to the space for diverting rising gas from the bore.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1:
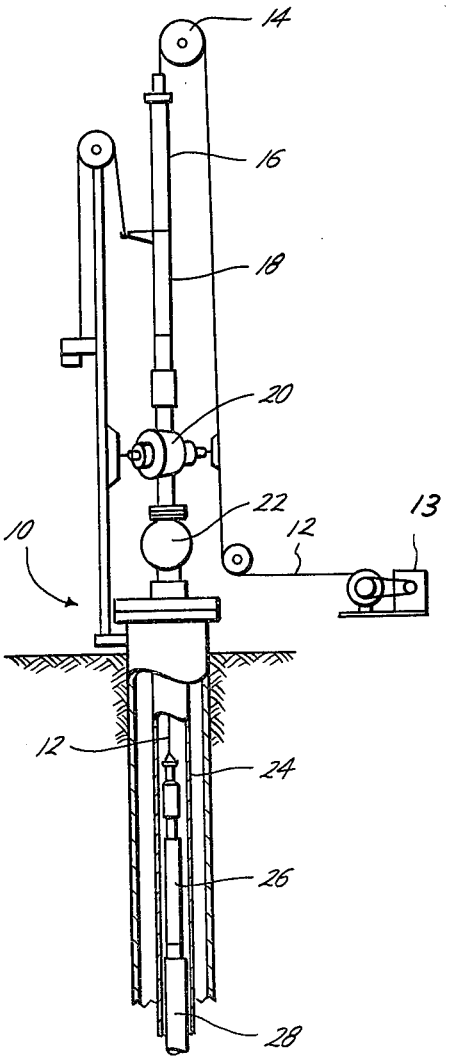
FIG. 1 is an elevational view, partly in cross section, showing the environment in which the present grease injection control head is used.

Referring now to the drawings, particularly to FIG. 1, a well head 10 is generally shown having a wireline operation in which a wireline 12 controlled by a control unit 13 extends over a pulley 14 through a grease injection control head 16, lubricator 18, blowout preventer 20 and valve 22 into tubing 24 in a well. The wireline 12 normally supports a tool string and one or more weight bars 26 and jars 28 for inserting a well tool or removing a well tool from the tubing 24 or performing other downhole operations. Maintenance of a seal around the wireline 12 is important where the escape of well fluids and gases such as hydrogen sulfide would present a major hazard. However, the problem is increased where high pressure exists in the tubing 24. The sealing force against the wireline 12 must be increased to seal against the high pressures which increases friction on the wireline 12. This creates the need to increase the number of weight bars 26 so that well tools can move down the tubing 24 which then requires an unreasonably tall lubricator 18. Also the force required by the control unit 14 to withdraw the line 12 is icnreased. In some cases the friction creates high temperatures weakening the line 12. And as the depths at which the wireline in the well operations in the well increase, all of these factors including the weight of the wireline which increases, limits the operations which can be performed at greater depths.

The present invention is directed to a grease injector control head 16 which reduces the friction against the wireline 12 while maintaining a seal against the fluids and gases in the tubing 24, and effects a pressure drop to atmospheric with a minimum length.

Figure 2A:
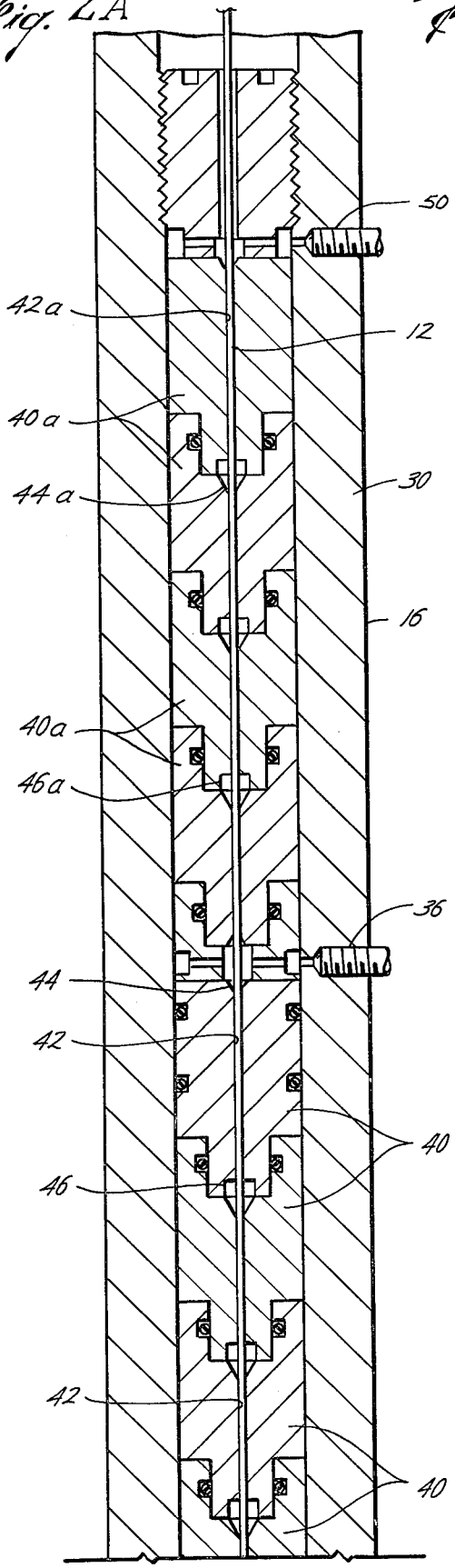
FIGS. 2A and 2B are enlarged elevational views, partly in cross section, and continuations of each other illustrating the improved grease injection control head of the present invention including a gas trap.
Figure 2B:
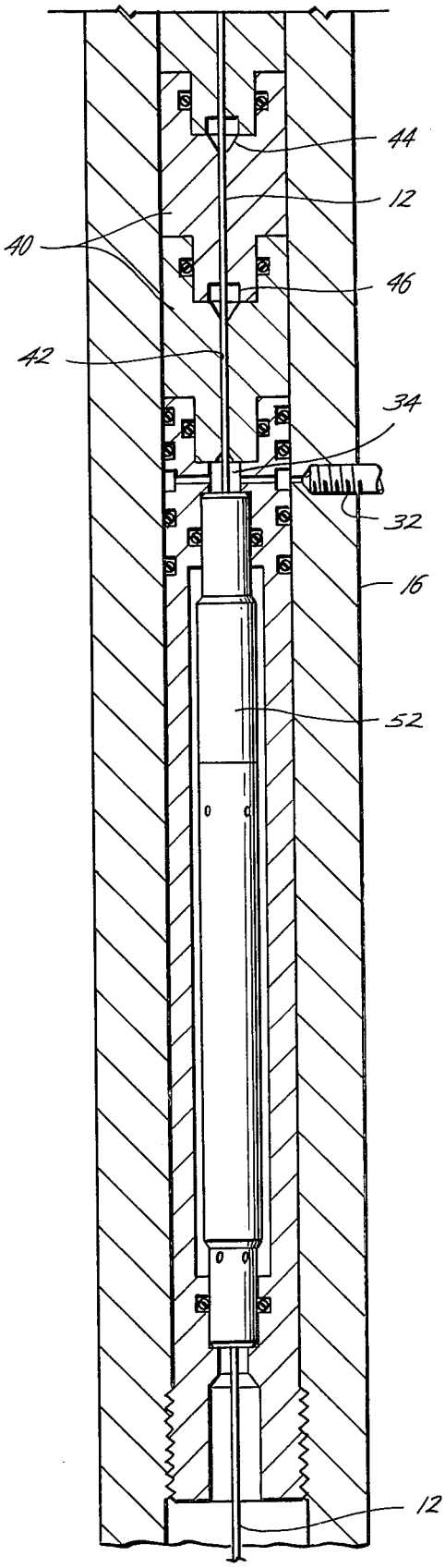

Referring now to FIGS. 2A and 2B, the grease injector control head 16 of the present invention is best seen which includes an elongate tubular body 30 having a grease injection port 32 for injecting what is commonly called grease, although it is in actuality a high viscous oil, into the interior 34 of the body 30 to counteract the pressure in the tubing 24. Generally, the pressure of the injected grease into the port 32 is about 1000 pounds greater than the well pressure in tubing 24. A vent port 36 is provided in the body 30 above the injection port 32 for venting the injected grease and any fluids from the interior of the body. The vent port 36 is normally at atmospheric pressure.

It is important to provide a seal against the wireline 12 to contain the fluids in the tubing 24, to distribute the pressure drop between the injection port 32 and the vent port 36 to reduce the friction between the control head 16 and the wireline 12, all within a control head 16 of reasonable height. This is accomplished by providing a plurality of tubular members 40 in the body 30 positioned between the injection port 32 and the vent port 36. The members 40 each include a close fitting longitudinal bore 42 for passage of the wireline 12. The close fitting bore 42 creates a pressure drop and a pressure seal all without gripping the wire 12. Preferably, the bore 42 is about 0.004 of an inch greater in diameter than the diameter of the wireline 12. The members 40 are telescopically and sealably joined to adjacent members. In addition, each of the members 40 include an enlarged cavity 44 and 46 at opposite ends thereby creating a turbulent grease chamber between adjacent members 40. The chambers between adjacent members 40 provide a labyrinth seal which distributes the pressure drop more evenly along the length of the body 30 between the injection port 32 and the vent port 33 which reduces the loading on the wire 12 and reduces friction. The top cavities 44 of the members 40 are preferably beveled downwardly and inwardly for threading the wireline 12 therethrough.

In one embodiment, six members 40 were positioned between the injector port 32 and the vent port 36. The longitudinal length of one of the bores 42 was two inches and the longitudinal length of the chamber between adjacent members 40 was one-half inch. By making the length of the longitudinal bores 42 relative to the longitudinal length of the chambers between the members 40 of approximately 3:1 the desired pressure drop is more evenly distributed between ports 32 and 36 could be achieved while having a minimum friction. In any case, the length of a longitudinal bore relative to the longitudinal axis of a chamber should be no greater than 5:1.

The vent 36 is preferably connected to an enclosure for insuring that any fluids from the well tubing 24 are collected in a location and container which will protect the surroundings. Preferably, a second vent 50 is provided in the body 16 above the first vent 36 for acting as a wiper vent port. One or more tubular members **40*a* similar to the tubular members 40 are provided having longitudinal bores 42*a* and enlarged cavities 44*a* and 46*a*. This provides a pressure barrier between the first and second vent ports 36 and 50 and insures that any deliterious materials will flow out of the first vent port 36 and also insures that the wire 12 coming out of the body 30** is substantially cleaned of even the injected grease.

Figure 3:
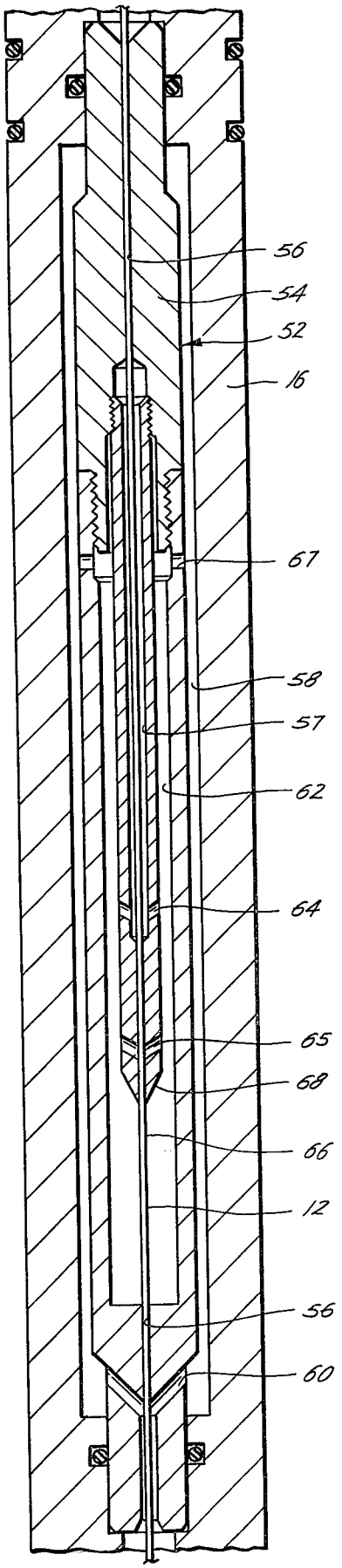
FIG. 3 is an enlarged cross-sectional elevational view of the gas trap of the present invention.

However, the fluids in the well tubing 24 may also include gas. Gas expands as it rises and encounters reduced pressures. It is undesirable for the gas to accumulate into the longitudinal bores 42 and **42*a* in the grease injection head 16 as the gas replaces the more viscous grease or oil and lowers the effective seal around the wireline 12 creating the possibility of the escape of gas out of the grease injector 16. This becomes particularly important as a safety factor in the event that the well gas includes hydrogen sulfide or other hazardous gases. Therefore, a gas trap 52 is provided in the body 16 below the injection port 32 for trapping gas from the well. Referring now to FIGS. 2B and 3, the gas trap 52 includes a housing 54 positioned in the body 16 and sealed at both ends relative to the body 16. The housing 54 includes a longitudinally extending bore 56 for accommodating the wireline 12. The gas trap 52 may provide various compartments for trapping and holding gas. For example, the housing 54 may include a chamber 62 surrounding but spaced from the bore 56. At least one opening and preferably a plurality of openings 64 extends upwardly from the bore 56 which may include an enlarged cavity 57, to the chamber 62 for receiving gas and accumulating rising gas from the bore 56 into the chamber 62. Additionally, openings 65 may be provided extending upwardly and outwardly from the bore 56 which tend to divert any gas rising therein. The chamber 62 may be connected to the bore 56 by an annular opening 66 surrounding the bore 56 with the top of the opening 66 closed by a conical partition 68 extending from the chamber 62 downwardly and inwardly to the bore 56 to form a gas deflector. The gas rising to opening 66 will disperse into the chamber 62, and will also be deflected by partition 68 away from the wire 12**.

In addition, the exterior of the housing 54 may be spaced from the interior of the body 16 to form a space 58 therebetween. At least one and preferably a plurality of openings 60 are provided extending upwardly from the bore 56 to the space 58 for diverting rising gas from the bore 56 and into the space 58. Further openings 67 are provided extending from chamber 62 to space 58 whereby accumulated gas in chamber 62 may be forced into space 58.

Grease or oil from the injection port 32 travels downwardly through the bore 56 of the gas trap 52 tending to fill up all of the voids and particularly flows out of passageways 64 and into chamber 62. Preferably, some of the grease is injected out of the bottom of the housing 54 to act as a barrier to any gas and to eject gas from the trap 52. However, in the event that some gas bubbles do enter into the lower end of the housing 54 they will tend to be diverted into the chamber 62 and space 58 instead of rising against the pressurized grease in the longitudinal bore 56. Furthermore, in the event the pressure of the accumulated gas in space 58 increases above the pressure in the tubing string 24, the gas will be forced outwardly through the bottom of the gas trap 52 and into the tubing 24.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. A gas trap for use with a wireline extending into a well for trapping gas rising in the well comprising, an outer body having an upper end and a lower end and adapted to be inserted into a well with the upper end adapted to be placed in communication with a grease lubricator and the lower end adapted to be exposed to fluids in the well, an inner housing having a longitudinally extending bore for accommodating a wireline and positioned in the body, the exterior of the housing spaced from the interior of the body forming a space therebetween, and at least one passageway extending upwardly from the bore through the housing to the space for diverting rising gas from the bore, said housing including means forming an internal chamber surrounding but spaced from the bore, and at least one opening extending upwardly from the bore to the chamber for diverting rising gas from the bore into the chamber, a passageway from the chamber to the space for transmitting gas from the chamber to the space.

2. The apparatus of claim 1 wherein the opening includes a circular opening surrounding the bore with the top of the opening closed by a partition extending from the chamber downwardly and inwardly to the bore to form a gas deflector.

3. In combination with a grease lubricator having an elongate body with a bore for passage of a wireline and a grease injection port for injecting sealing grease into the bore and a vent port above the injection port for venting fluids from the bore, of a gas trap comprising, a housing with a longitudinally extending bore for accommodating a wireline, said body adapted to be inserted into a well with the upper end adapted to be placed with the bore of the housing in communication with the bore of the grease lubricator for receiving grease therefrom and the lower end adapted to be exposed to fluids in the well, said housing including means forming an internal chamber surrounding but spaced from the bore, said housing including an opening extending upwardly from the bore in the housing to the chamber for diverting rising gas from the bore into the chamber a circular space spaced from and surrounding said housing chamber, and a passageway from the chamber to the space for transmitting gas from the chamber to the space.

4. The apparatus of claim 3 wherein said opening includes, a circular opening surrounding the housing bore with the top of the opening closed by a partition extending from the chamber downwardly and inwardly to the housing bore to form a deflector for deflecting gas from the bore into the chamber.

5. The apparatus of claim 4 including, said housing bore including an enlarged cavity for receiving grease, and a second opening extending from the cavity to the chamber and positioned above the first opening whereby grease may be injected through the bore into the chamber.

6. The apparatus of claim 5 including, at least one passageway extending upwardly from the housing bore through the housing to said space for diverting rising gas from the housing bore.

7. In combination with a grease lubricator having an elongate body with a bore for passage of a wireline and grease injection port for injecting sealing grease into the bore and a vent port above the injection port for venting fluids from the bore of a gas trap comprising, a housing with a longitudinally extending bore for accommodating a wireline, said body adapted to be inserted into a well with the upper end adapted to be placed with the bore of the housing in communication with the bore of the grease lubricator for receiving grease therefrom and the lower end adapted to be exposed to fluids in the well, said housing bore including an enlarged cavity for receiving grease, said housing including means forming an internal chamber surrounding but spaced from the bore, said housing having a plurality of openings extending upwardly from the bore in the housing to the chamber for diverting rising gas from the bore into the chamber, a circular space spaced from and surrounding said housing chamber, at least one passageway extending upwardly from the housing bore to said space for diverting rising gas from the housing bore, said passageway being positioned below said plurality of openings, another passageway from the chamber to the space for transmitting gas from the chamber to the space, said another passageway positioned above said plurality of openings.

8. The apparatus of claim 7 wherein one of the plurality of openings included, a circular opening surrounding the housing bore with the top of the circular opening closed by a partition extending from the chamber downwardly and inwardly to the bore to form a gas deflector.

9. The apparatus of claim 8 wherein one of the plurality of openings includes, an opening extending from the cavity to the chamber and positioned above the circular opening whereby grease may be injected through the bore into the chamber.

* * * * *